US010464192B2

(12) United States Patent
Cook

(10) Patent No.: US 10,464,192 B2
(45) Date of Patent: Nov. 5, 2019

(54) METHOD AND APPARATUS FOR APPLYING TORQUE

(71) Applicant: The Boeing Company, Chicago, IL (US)

(72) Inventor: Ryan Whalen Cook, Hawthorne, CA (US)

(73) Assignee: The Boeing Company, Chicago, IL (US)

( * ) Notice: Subject to any disclaimer, the term of this patent is extended or adjusted under 35 U.S.C. 154(b) by 448 days.

(21) Appl. No.: 15/347,306

(22) Filed: Nov. 9, 2016

(65) Prior Publication Data

US 2017/0057058 A1 Mar. 2, 2017

Related U.S. Application Data

(62) Division of application No. 14/271,637, filed on May 7, 2014, now Pat. No. 9,522,459.

(51) Int. Cl.
*B25B 13/46* (2006.01)
*B25B 17/02* (2006.01)

(52) U.S. Cl.
CPC ..... *B25B 13/467* (2013.01); *B25B 13/463* (2013.01); *B25B 13/465* (2013.01); *B25B 17/02* (2013.01); *Y10T 29/49964* (2015.01)

(58) Field of Classification Search
CPC ... B25B 13/463; B25B 13/465; B25B 13/467; B25B 17/02; B25B 17/12
See application file for complete search history.

(56) References Cited

U.S. PATENT DOCUMENTS

| | | | |
|---|---|---|---|
| 755,569 | A | 3/1904 | Freeland |
| 1,860,914 | A | 5/1932 | Wellman |
| 1,957,462 | A | 5/1934 | Kress et al. |
| 2,558,897 | A | 7/1951 | Akins |
| 2,641,136 | A | 6/1953 | Marsden, Jr. et al. |
| 3,467,231 | A | 9/1969 | Haznar |
| 3,587,364 | A | 6/1971 | Peyre |
| 3,828,629 | A | 8/1974 | Moore |
| 4,426,895 | A | 1/1984 | Lack |
| 4,507,990 | A | 4/1985 | Lack |

(Continued)

OTHER PUBLICATIONS

"M3 Design Product Teardown Kobalt Double-Drive™ Screwdriver", Retrieved from the Internet: < http://www.m3design.com/wordpress/wp-content/uploads/2013/11/Product-Teardown-Kobalt-Double-Drive.pdf >, Jun. 19, 2013, 11 pgs.

(Continued)

*Primary Examiner* — Monica S Carter
*Assistant Examiner* — Danny Hong
(74) *Attorney, Agent, or Firm* — Kwan & Olynick LLP

(57) ABSTRACT

One example of the present disclosure relates to a method of applying torque to an object, which threadably engages a part. The torque is applied with a wrench, comprising a first handle, a second handle, a planetary gear mechanism, a drive that comprises an internal gear and an external gear, and a first pawl, movably coupled to the first handle and biased to contact the external gear of the drive. When the drive is coupled to the object, the method comprises transmitting an input torque to the drive by rotating at least one of the first handle and the second handle relative to the part. The first pawl is movable between a first position and a second position relative to the first handle may or may not operatively engage the external gear of the drive.

20 Claims, 16 Drawing Sheets

(56) References Cited

U.S. PATENT DOCUMENTS

| | | | |
|---|---|---|---|
| 4,546,676 | A | 10/1985 | Kiefer, Jr. |
| 4,800,785 | A | 1/1989 | Christensen |
| 6,681,660 | B2 | 1/2004 | Foard |
| 2015/0321322 | A1 | 11/2015 | Cook et al. |

OTHER PUBLICATIONS

"U.S. Appl. No. 14/271,637, Examiner Interview Summary dated Sep. 9, 2016", 3 pgs.
"U.S. Appl. No. 14/271,637, Non Final Office Action dated Jul. 5, 2016", 12 pgs.
"U.S. Appl. No. 14/271,637, Notice of Allowance dated Sep. 30, 2016", 7 pgs.
"U.S. Appl. No. 14/271,637, Restriction Requirement dated Jan. 15, 2016", 6 pgs.

METHOD AND APPARATUS FOR APPLYING TORQUE

CROSS-REFERENCE TO RELATED APPLICATIONS

This application is a divisional of U.S. application Ser. No. 14/271,637, entitled: "METHOD AND APPARATUS FOR APPLYING TORQUE" filed on 2014 May 7, which is incorporated herein by reference in its entirety for all purposes.

BACKGROUND

When assembling bolted and other threadably coupled joints, torque needs to be applied to the threadable coupling (s). Various types of ratcheting wrenches, including those with double-drive gearing, may be used for this purpose. However, existing wrenches with double-drive gearing deliver limited torque output in the double-drive mode and require a twisting motion, which may fatigue the user's wrist during prolonged operation.

SUMMARY

Accordingly, apparatus and method, intended to address the above-identified concerns, would find utility.

One example of the present disclosure relates to a wrench for applying torque to an object threadably engaging a part. The wrench includes a first handle, a second handle, a drive, a planetary gear mechanism, a first pawl, and at least one second pawl. The drive includes an internal gear and an external gear. The planetary gear mechanism includes a ring gear, a sun-gear component including a sun gear, and a planetary carrier including at least one pinion gear in mesh with the ring gear and the sun gear. The first handle is coupled to the ring gear. The second handle is coupled to the planetary carrier. The first pawl is movably coupled to the first handle and is biased to contact the external gear of the drive. The at least one second pawl is movably coupled to the sun-gear component and is biased to contact the internal gear of the drive.

One example of the present disclosure relates to a method of applying torque to an object that threadably engages a part. The torque is applied using a wrench that includes a drive, a first handle coupled to the drive, and a second handle coupled to the drive and movable relative to the first handle. The method involves transmitting an input torque to the drive that is coupled to the object by rotating at least one of the first handle and the second handle relative to the part.

BRIEF DESCRIPTION OF THE DRAWINGS

Having thus described examples of the disclosure in general terms, reference will now be made to the accompanying drawings, which are not necessarily drawn to scale, and wherein like reference characters designate the same or similar parts throughout the several views, and wherein:

FIG. 1 is a block diagram of a wrench, according to one aspect of the present disclosure;

FIG. 2A is a schematic exploded view of the wrench of FIG. 1, according to one aspect of the disclosure;

FIG. 2B is a schematic perspective view of the wrench of FIG. 1, according to one aspect of the disclosure;

FIG. 2C is a schematic sectional view of the wrench of FIG. 1 according to one aspect of the disclosure;

FIG. 2D is a schematic view of a sun-gear component of the wrench of FIG. 1 according to one aspect of the disclosure;

FIG. 2E-2L are schematic sectional views of the wrench of FIG. 1, illustrating different positions of its pawls, according to one aspect of the disclosure;

FIG. 3 is a block diagram of a method of applying torque to an object using the wrench of FIG. 1, according to one aspect of the disclosure;

FIGS. 4A-4C are schematic perspective views of the wrench of FIG. 1 illustrating different position of its handles, according to one aspect of the disclosure;

FIGS. 4D-4G are schematic perspective views of the wrench of FIG. 1 illustrating different rotating directions of its handles, according to one aspect of the disclosure;

FIG. 5 is a block diagram of aircraft production and service methodology; and FIG. 6 is a schematic illustration of an aircraft.

In the block diagram(s) referred to above, solid lines connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. Couplings other than those depicted in the block diagrams may also exist. Dashed lines, if any, connecting the various elements and/or components represent couplings similar in function and purpose to those represented by solid lines; however, couplings represented by the dashed lines are either selectively provided or relate to alternative or optional aspects of the disclosure. Likewise, any elements and/or components, represented with dashed lines, indicate alternative or optional aspects of the disclosure. Environmental elements, if any, are represented with dotted lines.

In the block diagram(s) referred to above, the blocks may also represent operations and/or portions thereof. Lines connecting the various blocks do not imply any particular order or dependency of the operations or portions thereof.

DETAILED DESCRIPTION

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Reference herein to "one example" or "one aspect" means that one or more feature, structure, or characteristic described in connection with the example or aspect is included in at least one implementation. The phrase "one example" or "one aspect" in various places in the specification may or may not be referring to the same example or aspect.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Figure 1:
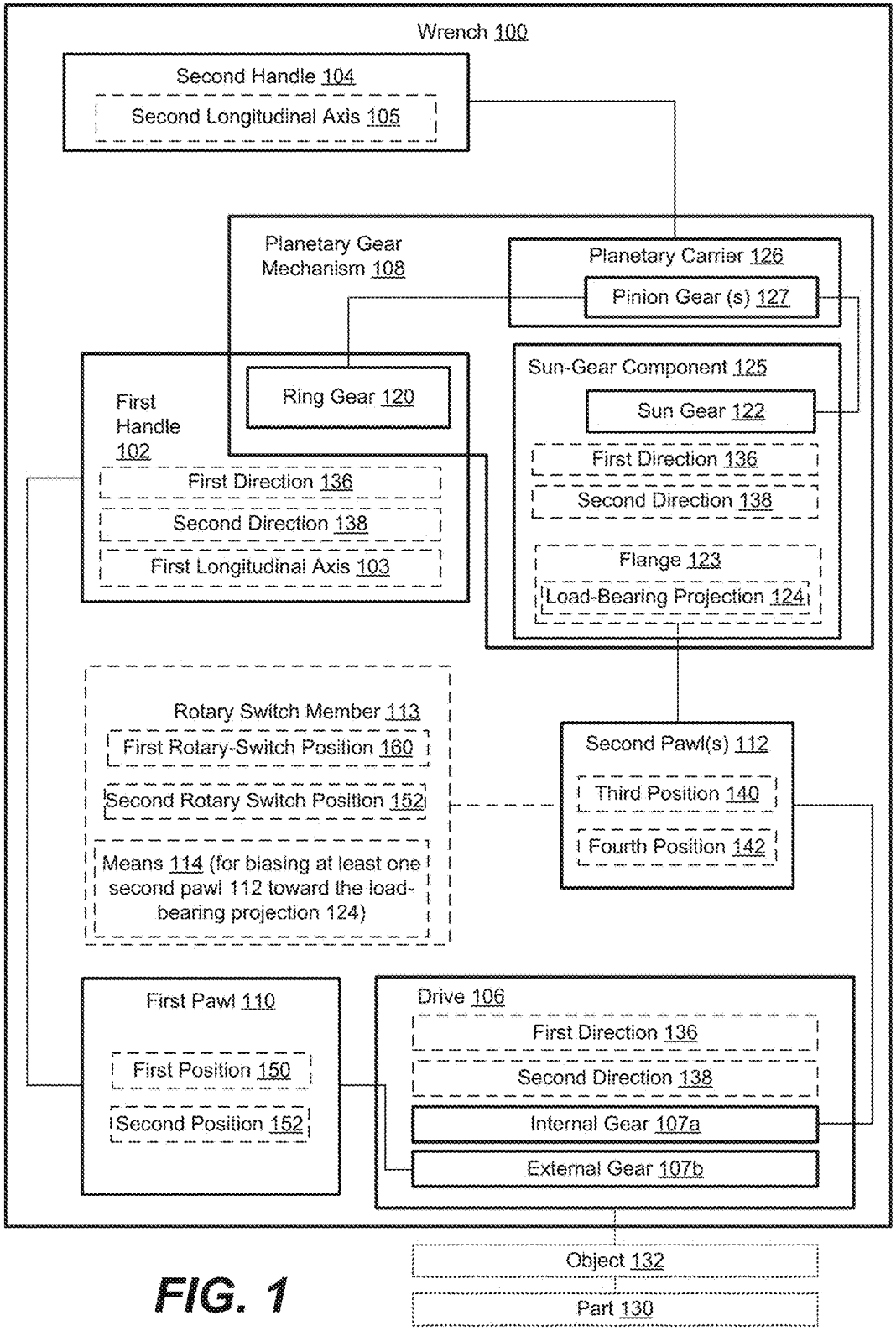

Referring generally to FIGS. 1, 2A-2C, and with particular reference to FIG. 1, one example of the present disclosure relates to a wrench 100 for applying torque to an object 132 (e.g., a nut, a bolt, a screw, etc.) threadably engaging a part 130. The wrench 100 includes a first handle 102, a second handle 104, a drive 106, a planetary gear mechanism 108, a first pawl 110, and at least one second pawl 112. The drive 106 includes an internal gear 107*a* and an external gear 107*b*. The planetary gear mechanism 108 includes a ring gear 120, a sun-gear component 125 including a sun gear 122, and a planetary carrier 126 including at least one pinion gear 127 in mesh with the ring gear 120 and the sun gear 122. The first handle 102 is coupled to the ring gear 120. The second handle 104 is coupled to the planetary carrier 126. The first pawl 110 is movably coupled to the first handle 102 and biased to contact the external gear 107*b* of the drive 106. The at least one second pawl 112 is movably coupled to the sun-gear component 125 and is biased to contact the internal gear 107*a* of the drive 106.

As used herein, "to bias" means to continuously apply a force, which may or may not have a constant magnitude. Referring, e.g., to FIG. 2C, in one example, the first pawl 110 is pivotably coupled to the first handle 102 and is biased, using means 116, to contact the external gear 107*b* in a selected one of two positions of the first pawl 110 relative to the first handle 102. The rotation direction of the drive 106 relative to the first handle 102 is determined, at least in part, by the position of the first pawl 110 relative to the first handle 102. Likewise, the at least one second pawl 112 is pivotably coupled to the sun-gear component 125 and is biased, using means 114 (further discussed below), to engage the internal gear 107*a* of the drive 106 in a selected one of two positions of the at least one second pawl 112 relative to the sun-gear component 125. In one example, the sun-gear component 125 may include cylindrical post(s) 133 that may extend into corresponding cylindrical opening(s) of the second pawl(s) 112, thereby providing a pivotable coupling between the second pawl(s) 112 and the sun-gear component 125. A similar pivotable coupling may be used between the first pawl 110 and the first handle 102. The rotation direction of the drive 106 relative to the sun-gear component 125 is determined, at least in part, by the position of the second pawl(s) 112 relative to the sun-gear component 125.

As used herein, means 114 and 116 are to be interpreted under 35 U.S.C. 112(f), unless otherwise explicitly stated. It should be noted that examples provided herein of any structure, material, or act in support of any of the means-plus-function clauses, and equivalents thereof may be utilized individually or in combination. Thus, while various structures, materials, or acts may be described in connection with a means-plus-function clause, any combination thereof or of their equivalents is contemplated in support of such means-plus-function clause.

Figure 2A:
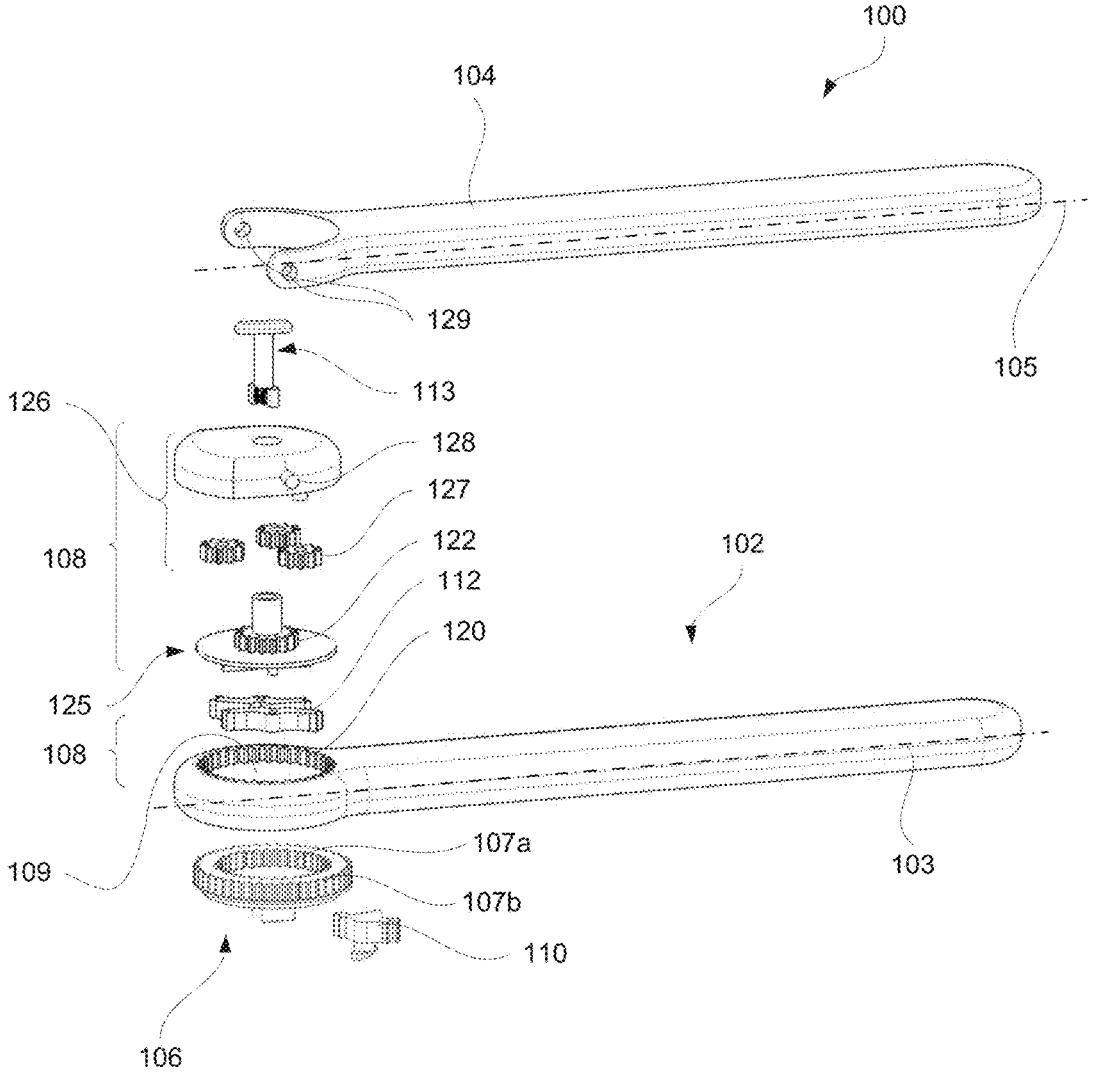

Referring, e.g., to FIG. 2A, the first handle 102 may be fixedly coupled to the ring gear 120 and may be rotatably coupled to the planetary carrier 126 via the ring gear 120. Those skilled in the art will appreciate that the coupling between the first handle 102 and the ring gear 120 is such that a given rotation of the first handle 102 about a torque axis causes an identical rotation of the ring gear 120 about the same axis. Likewise, the second handle 104 is coupled to the planetary carrier 126 such that a rotation of the second handle 104 about a torque axis causes an identical rotation of the planetary carrier 126 about the same axis. It should be noted that the coupling between the second handle 104 and the planetary carrier 126 may be a tiltable coupling, whereby the second handle 104 tilts relative to the planetary carrier 126 about one or more axes. Additional details of the tiltable coupling between the second handle 104 and the planetary carrier 126 are provided below. Those skilled in the art will appreciate that, even when the coupling between the second handle 104 and the planetary carrier 126 is tiltable, a given rotation of the second handle 104 about a torque axis causes an identical rotation of the planetary carrier 126 about the same axis regardless of the orientation of the second handle 104 relative to the planetary carrier 126.

Figure 4A:
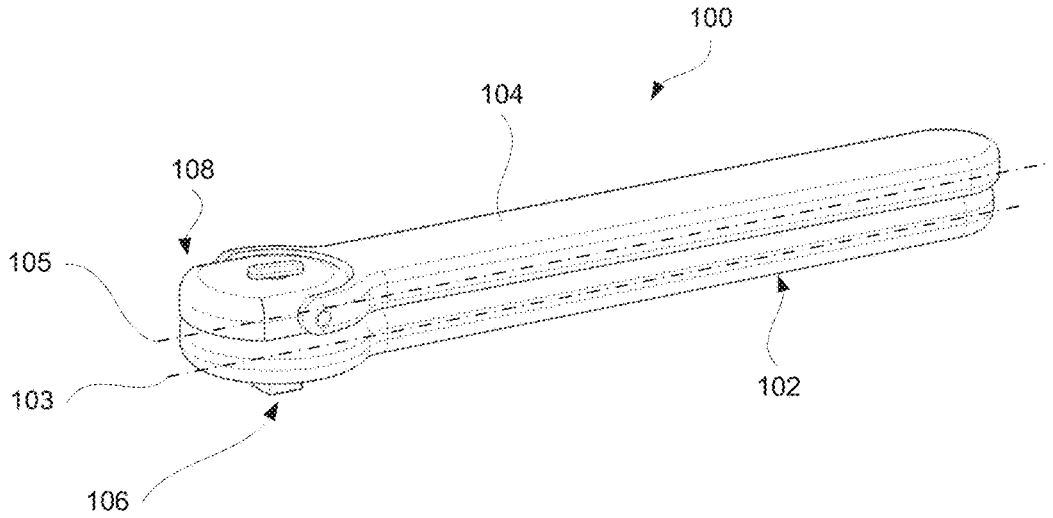
Figure 4B:
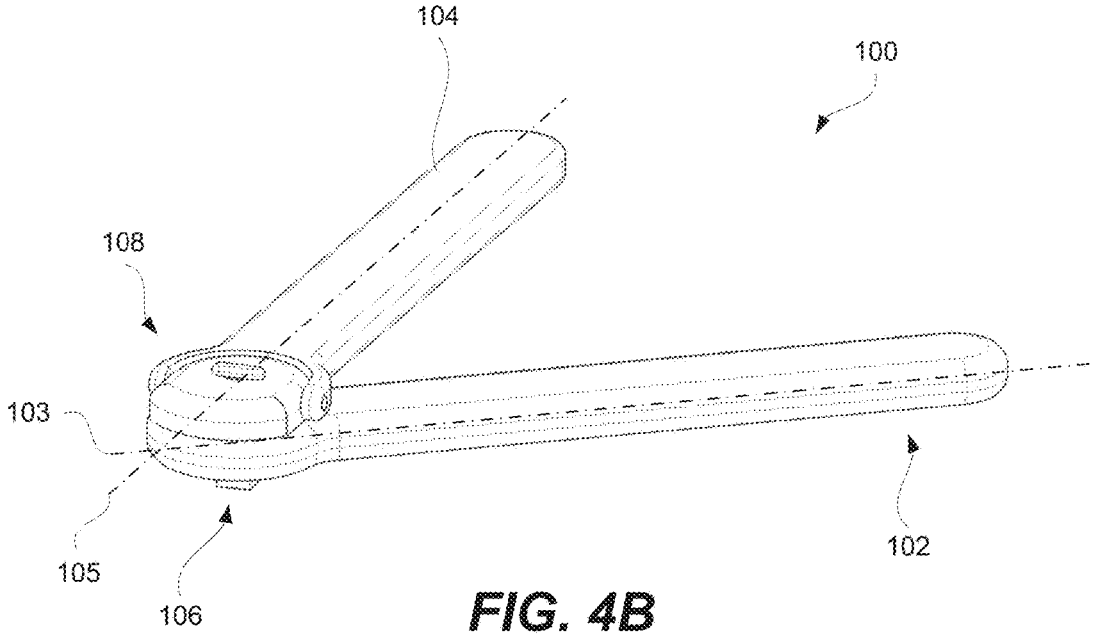
Figure 4C:
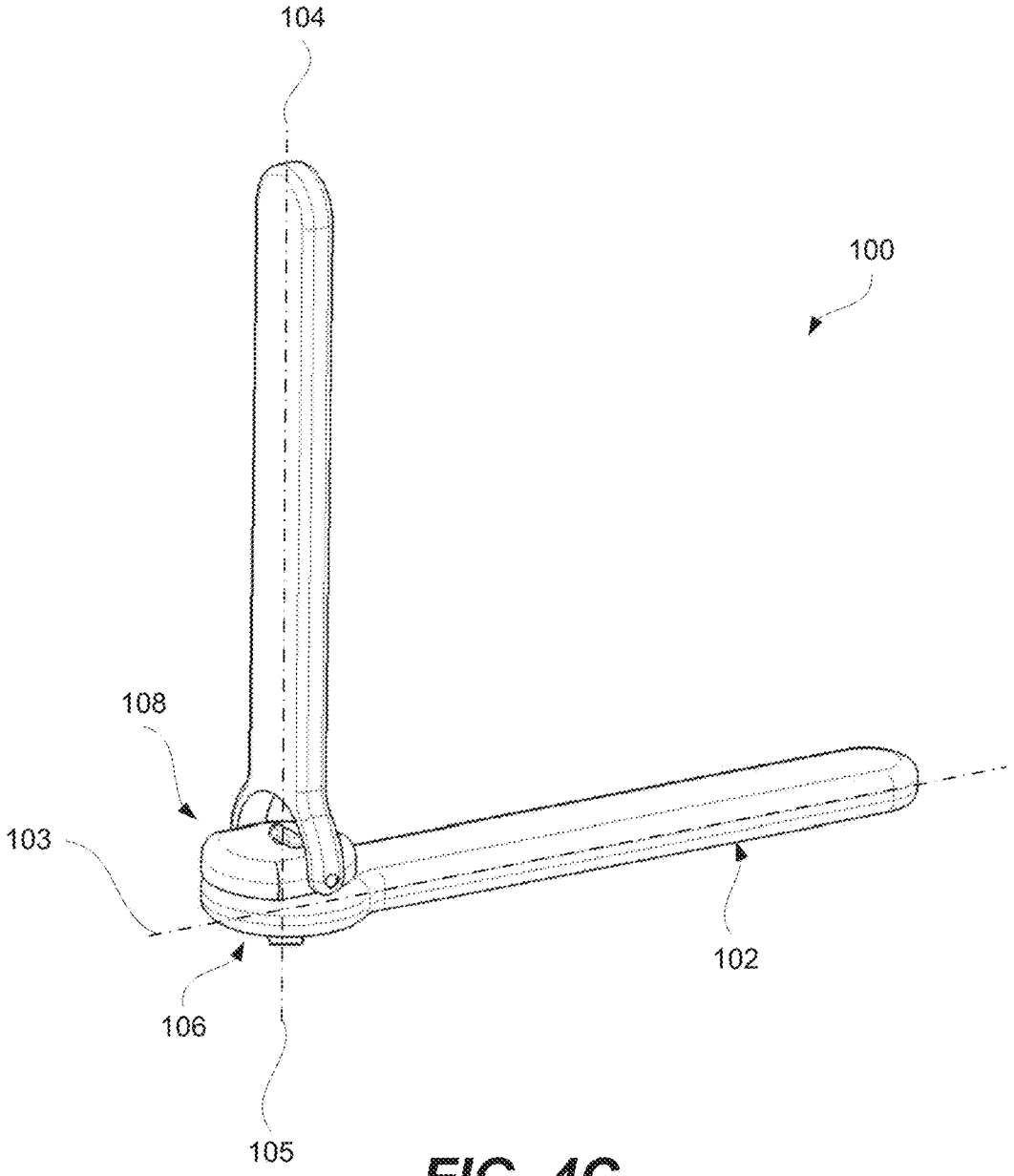
Figure 4D:
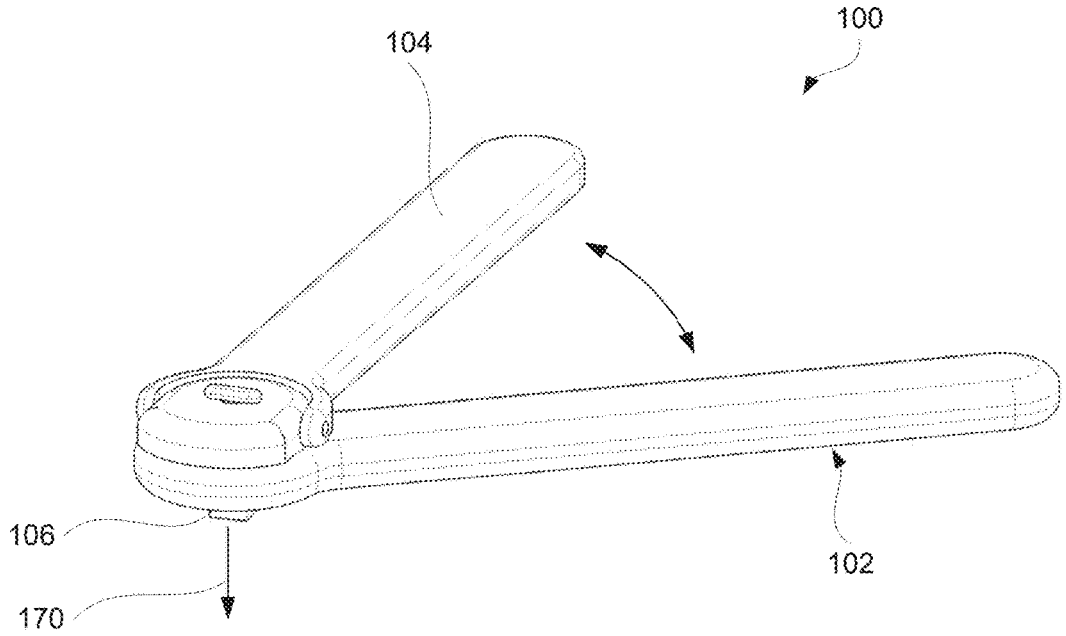
Figure 4E:
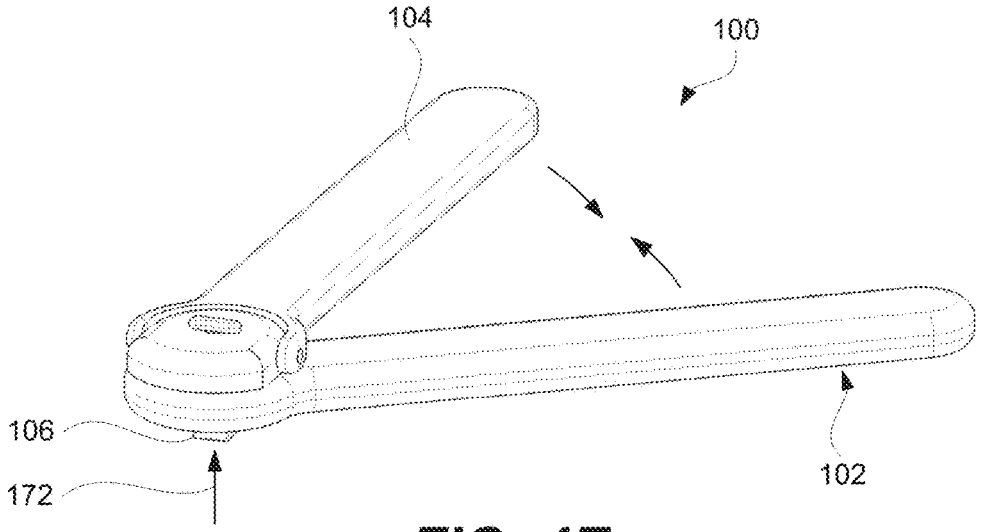
Figure 4F:
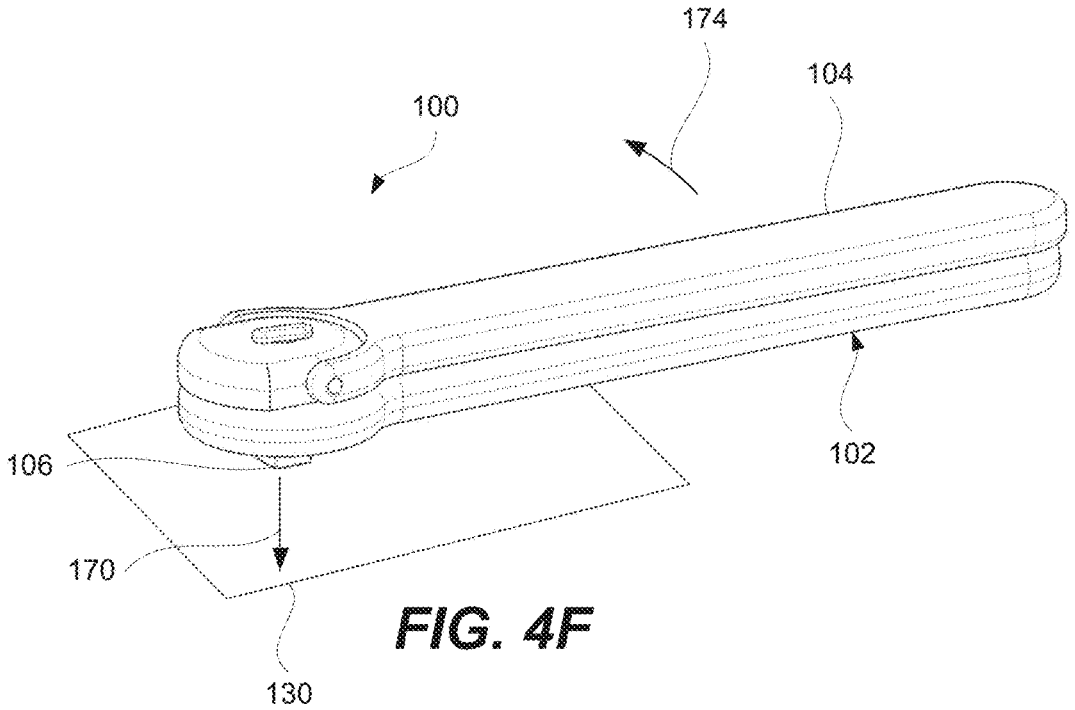
Figure 4G:
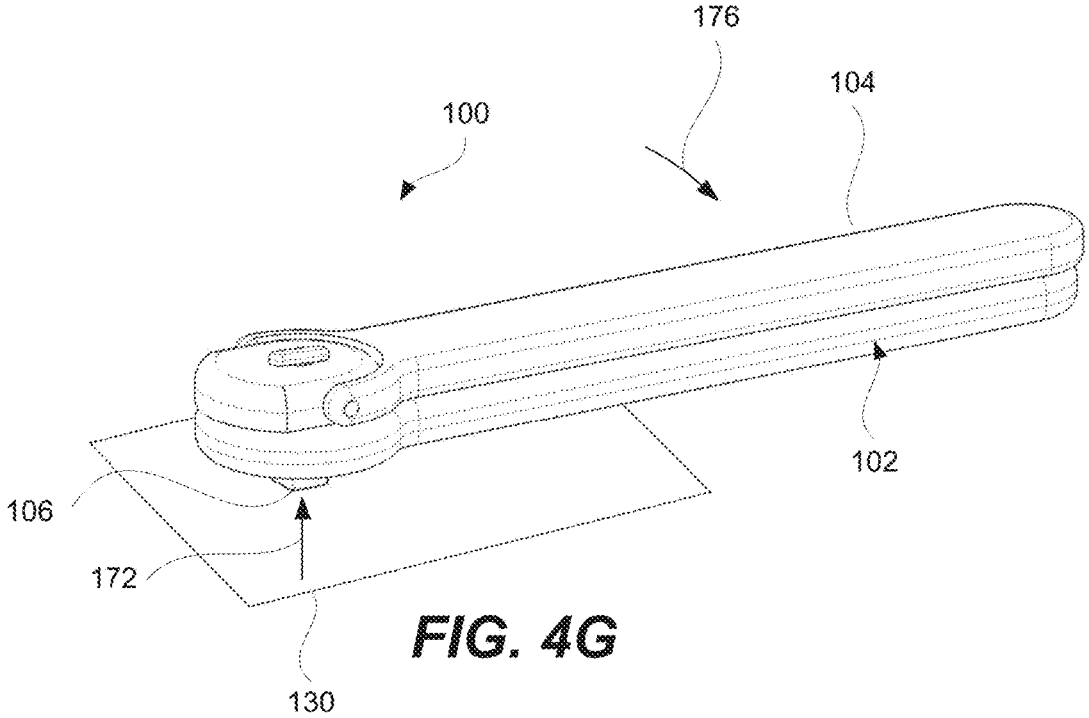

As previously discussed with reference to FIG. 2A, in one aspect of the disclosure, which may include at least a portion of the subject matter of any of the preceding and/or following examples and aspects, the second handle 104 is tiltably coupled to the planetary carrier 126. For example, the planetary carrier 126 may include an axle or trunnions 128, while the second handle 104 may include openings 129 for receiving the axle or trunnions 128 of the planetary carrier 126. With the axle or trunnions 128 of the planetary carrier 126 received in the openings 129 of the second handle 104, the second handle 104 can transfer the torque along one axis (i.e., the torque axis) and can tilt around another axis (i.e., the tilt axis). The torque axis may be substantially normal to the tilt axis. The tiltable coupling between the planetary carrier 126 and the second handle 104 enables the second handle 104 to tilt with respect to, e.g., the first handle 102. The tiltable coupling may be used to more comfortably position the second handle 104 relative to the first handle 102 when operating the wrench. Illustrative orientations of the first handle 102 relative to the second handle 104 enabled by the tiltable coupling therebetween are shown in FIGS. 4A and 4C.

As previously discussed with reference to FIG. 2A, in one aspect of the disclosure, which may include at least a portion of the subject matter of any of the preceding and/or following examples and aspects, the ring gear 120 of the planetary gear mechanism 108 is fixed to the first handle 102. In one example, the ring gear 120 may be a component fixedly mounted (non-rotatably coupled) within a receiving opening of the first handle 102. Specifically, the ring gear 120 may be welded, soldered, bonded, or press fit into the receiving opening of the first handle 102. Alternatively, the ring gear 120 may be formed integrally with the first handle 102 as a monolithic body, e.g., by casting, forging, or additive manufacturing.

Figure 2B:
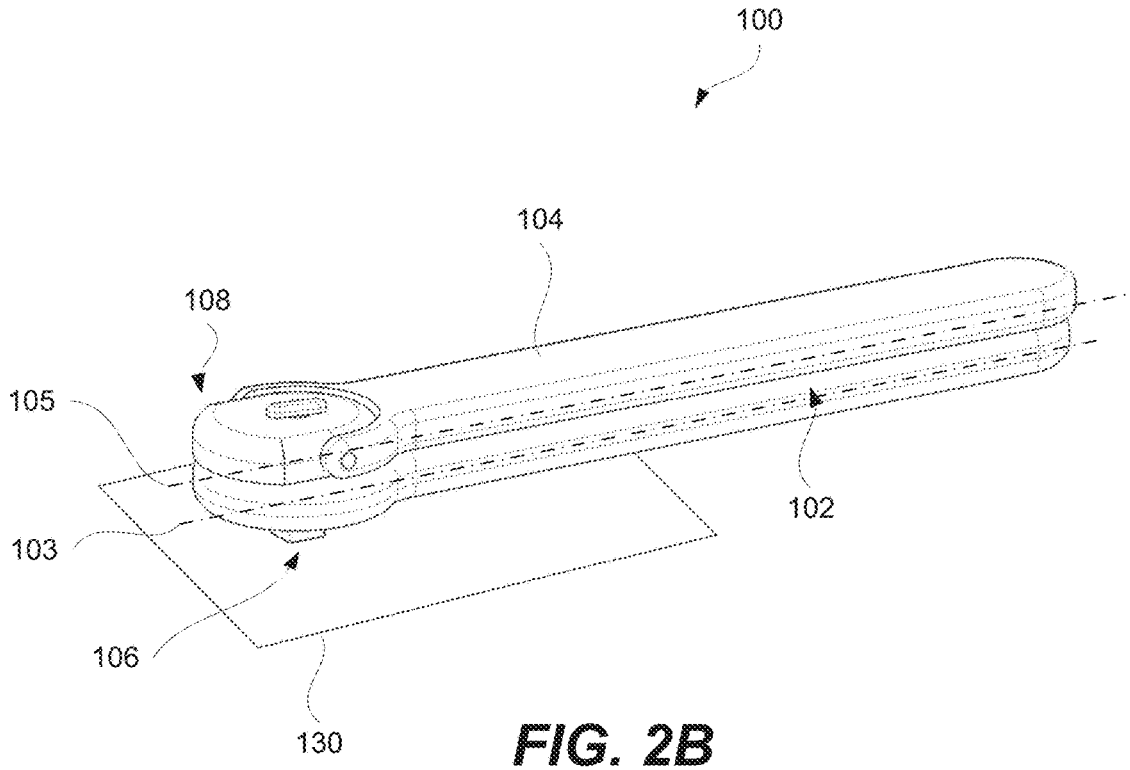
Figure 2C:
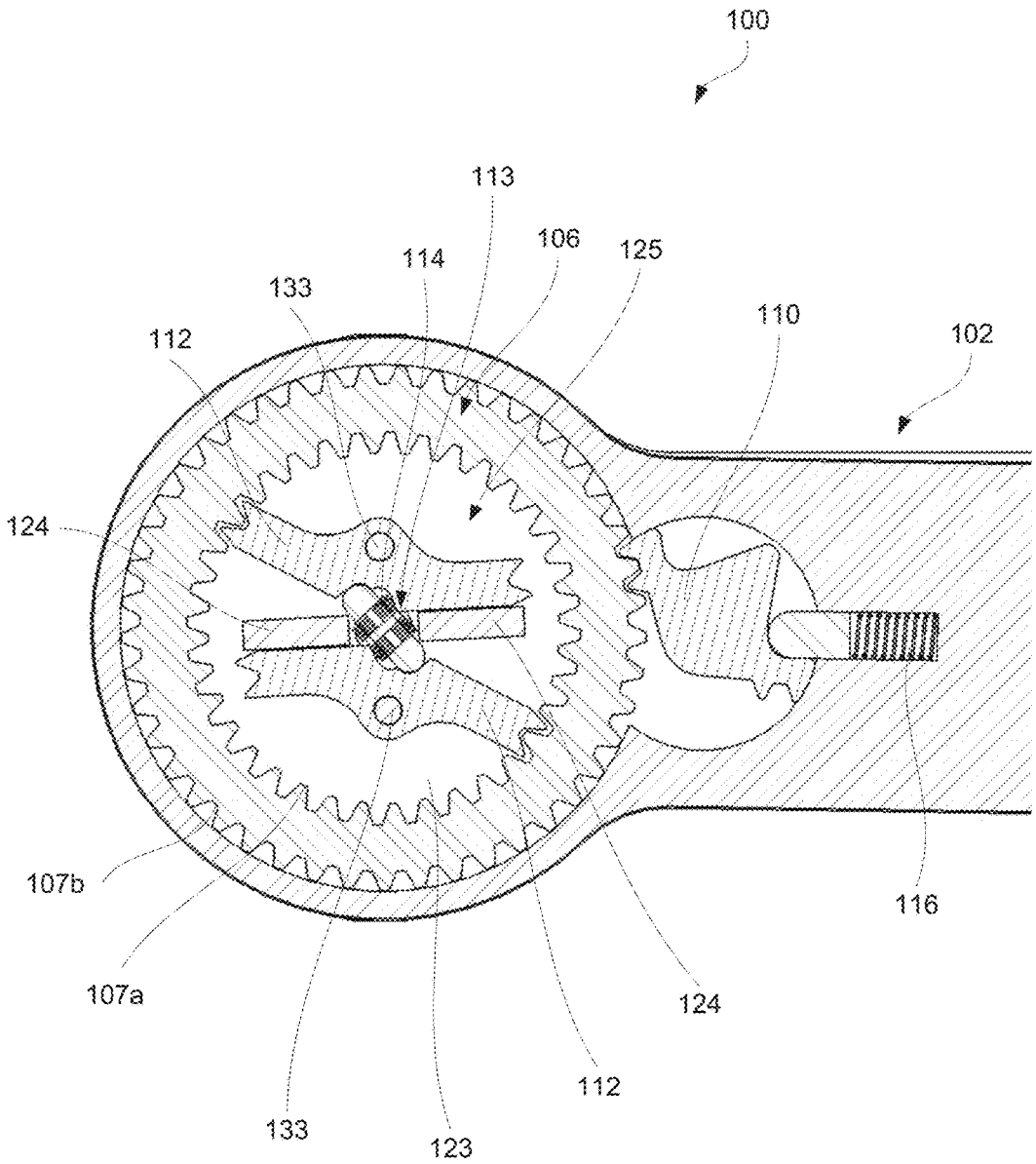

Referring to FIGS. 1, 2A, and 2C, in one aspect of the disclosure, which may include at least a portion of the subject matter of any of the preceding and/or following examples and aspects, the at least one second pawl 112 includes multiple pawls. For example, the at least one second pawl 112 may include two pawls as shown in FIGS. 2A and 2C. The two pawls may be positioned directly opposite from each other with respect to the torque axis. Such orientation of the second pawls allows for even distribution of forces between the sun-gear component 125 and the internal gear 107*a* or, more specifically, balancing the forces around the torque axis. When multiple pawls 112 are used, all of these pawls are configured to selectively engage the internal gear 107*a* at the same time. [0025] Referring once again to FIG. 1 and, as previously discussed with referenced to FIG. 2A, in one aspect of the disclosure, which may include at least a portion of the subject matter of any of the preceding and/or following examples and aspects, the planetary carrier 126 is rotatably coupled to the first handle 102. The rotatable coupling of the planetary carrier 126 and the first handle 102 enables operation of the planetary gear mechanism 108 when the first handle 102 is rotated with respect to the second handle 104 about a torque axis. Specifically, rotation of the first handle 102 with respect to the second handle 104 causes rotation of the pinion gear(s) 127 relative to the ring gear 120 in mesh therewith. The at least one pinion gear 127 is rotatably coupled to the planetary carrier 126, which is coupled to the second handle 104 in a manner described above. As explained previously, the ring gear 120 is fixed relative to the first handle

102. Those skilled in the art will appreciate that the rotation of the pinion gear(s) 127 with respect to the ring gear 120 causes rotation of the sun gear 122 and the sun-gear component 125, which is monolithic with or fixedly coupled to the sun gear 122. Depending on the position of the second pawl(s) 112 and the rotation direction of the sun-gear component 125, the sun-gear component 125 may transfer torque to the drive 106 through the second pawl 112(*s*), engaging the internal gear 107*a* of the drive 106.

In one example, the rotatable coupling between the planetary carrier 126 and the first handle 102 is configured to prevent the planetary carrier 126 and the first handle 102 from moving with respect to each other along the torque axis to avoid disengagement of the ring gear 120, the pinion gear(s) 127, and the sun gear 122 of the planetary gear mechanism 108. In this respect, the rotatable coupling of the planetary carrier 126 and the first handle 102 may be provided by a mechanism that allows the planetary carrier 126 and the first handle 102 to rotate relative to each other about the torque axis, but prevents movement of the planetary carrier 126 with respect to the first handle 102 along the torque axis. One example of such a mechanism is a groove and retention ring combination (not shown), associated, e.g., with the sun-gear component 125 and engaging the planetary carrier 126.

Referring to FIGS. 1, 2A, and 2C, in one aspect of the disclosure, which may include at least a portion of the subject matter of any of the preceding and/or following examples and aspects, the drive 106 is rotatably coupled to the first handle 102. The rotatable coupling between the drive 106 and the first handle 102 allows torque to be transmitted from the planetary gear mechanism 108 to the object 132 via the drive 106. Referring to FIG. 2C, the drive 106 may be rotatably received within a cavity 109 formed in the first handle 102. In one example, a thrust bearing (not shown) may be interposed between the drive 106 and the bottom of the cavity 109 to promote rotary motion of the drive 106 relative to the first handle 102. The rotatable coupling between the drive 106 and the first handle 102 may be configured to prevent the drive 106 and the first handle 102 from moving relative to each other along the torque axis to avoid disengagement of the first pawl 110 from the external gear 106*b* of the drive 106 and of the second pawl(s) 112 form the internal gear 107*a* of the drive. In this respect, the rotatable coupling of the drive 106 and the first handle 102 may be provided by a mechanism that allows the drive 106 and the first handle 102 to rotate relative to each other about the torque axis, but prevents movement of the drive 106 with respect to the first handle 102 along the torque axis. One example of such a mechanism is a groove and retention ring (not shown) located, e.g., within the cavity 109 of the first handle 102 and rotatably engaging the drive 106.

Referring to FIGS. 2A, 2B and 4A-4C, in one aspect of the disclosure, which may include at least a portion of the subject matter of any of the preceding and/or following examples and aspects, the second handle 104 is rotatably coupled to the first handle 102. The first handle 102 has a first longitudinal axis 103, as shown in FIG. 2B. The second handle 104 has a second longitudinal axis 105, as also shown in FIG. 2B. The first longitudinal axis 103 is not collinear with the second longitudinal axis 105. In one example, the rotatable coupling between the first handle 102 and the second handle 104 includes the above-described rotatable coupling between the first handle 102 and the planetary carrier 126. The rotatable coupling between the first handle 102 and the second handle 104 may also include the above-described tiltable coupling between the second handle 104 and the planetary carrier 126, provided by, e.g., the axle or trunnions 128 and the openings 129 configured to mate therewith. Specifically, rotation of the second handle 104 with respect to the first handle 102 around the torque axis causes rotation of the planetary carrier 126 with respect to the first handle 102 around the same torque axis. The relative rotation of the planetary carrier 126 and the first handle 102 operates the planetary gear mechanism 108.

During operation of the wrench 100, the orientation of the first longitudinal axis 103 and the second longitudinal axis 105 may change due to rotation of the first handle 102 with respect to the second handle 104 about the torque axis and/or due to tilting of the second handle 104 with respect to the planetary carrier 126. In some instances, the first longitudinal axis 103 may be parallel to the second longitudinal axis 105 as, for example, shown in FIGS. 2B and 4A. However, the first longitudinal axis 103 and the second longitudinal axis 105 are never collinear during operation of the wrench 100.

Referring, e.g., to FIG. 2A, in one aspect of the disclosure, which may include at least a portion of the subject matter of any of the preceding and/or following examples and aspects, the second handle 104 is rotatably coupled to the first handle 102 by the planetary gear mechanism 108, which includes the planetary carrier 126. The rotatable coupling of the planetary carrier 126 and the first handle 102 was described in detail above.

Referring, e.g., to FIGS. 2E-2H, in one aspect of the disclosure, which may include at least a portion of the subject matter of any of the preceding and/or following examples and aspects, the first pawl 110 is movable between a first position 150 (e.g., FIGS. 2E and 2F) and a second position 152 (e.g., FIGS. 2G and 2H) relative to the first handle 102. As shown, for example, in FIG. 2E, when the first handle 102 is rotated in a first direction 136 relative to the part 130, the first pawl 110 is in the first position 150, and the first pawl 110 operatively engages the external gear 107*b* of the drive 106, the drive 106 rotates in the first direction 136 relative to the part 130. As shown, for example, in FIG. 2F, when the first handle 102 is rotated in a second direction 138 relative to the part 130 opposite to the first direction 136, the first pawl 110 is in the first position 150, and the first pawl 110 does not operatively engage the external gear 107*b* of the drive 106, the drive 106 rotates in the first direction 136 relative to the part 130. As shown, for example, in FIG. 2G, when the first handle 102 is rotated in the second direction 138 relative to the part 130, the first pawl 110 is in the second position 152, and the first pawl 110 operatively engages the external gear 107*b* of the drive 106, the drive 106 rotates in the second direction 138 relative to the part 130. As shown, for example, in FIG. 2H, when the first handle 102 is rotated in the first direction 136 relative to the part 130, the first pawl 110 is in the second position 152, and the first pawl 110 does not operatively engage the external gear 107*b* of the drive 106, the drive 106 rotates in the second direction 138 relative to the part 130.

Figure 2D:
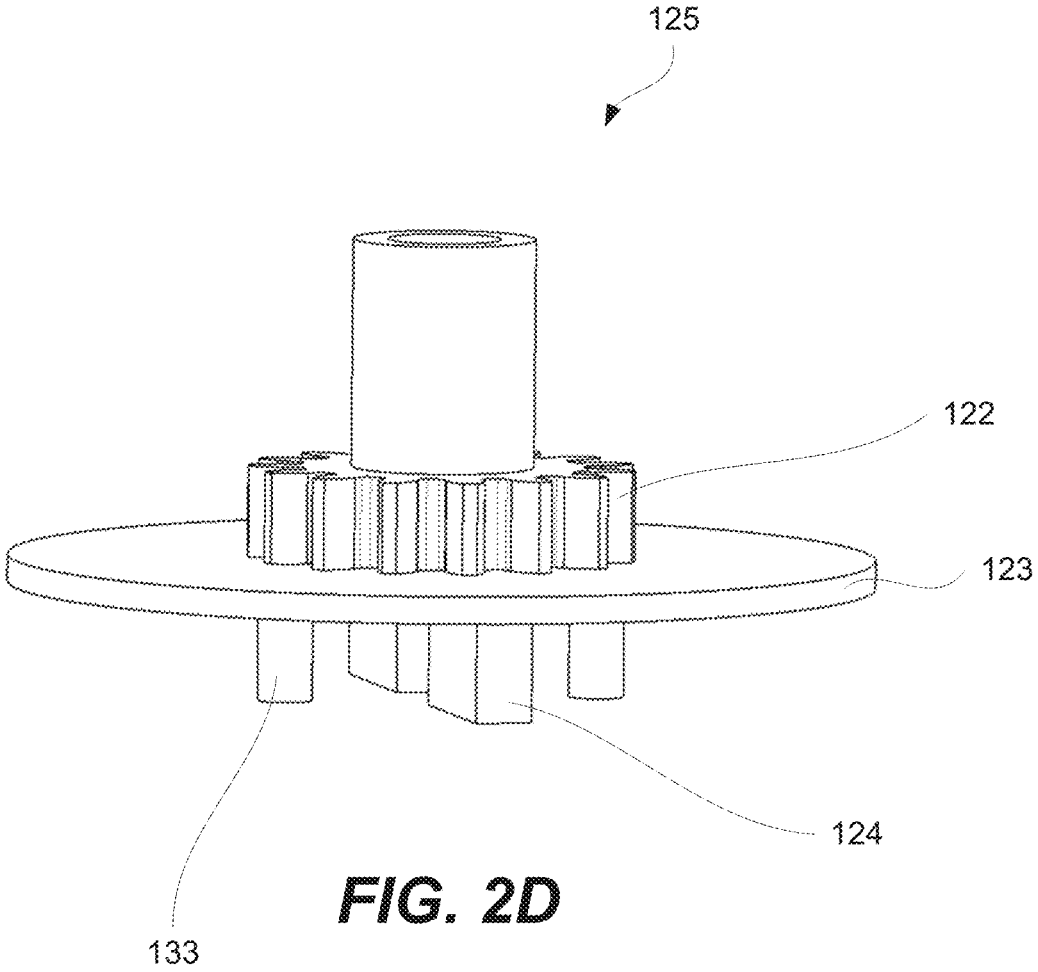
Figure 2E:
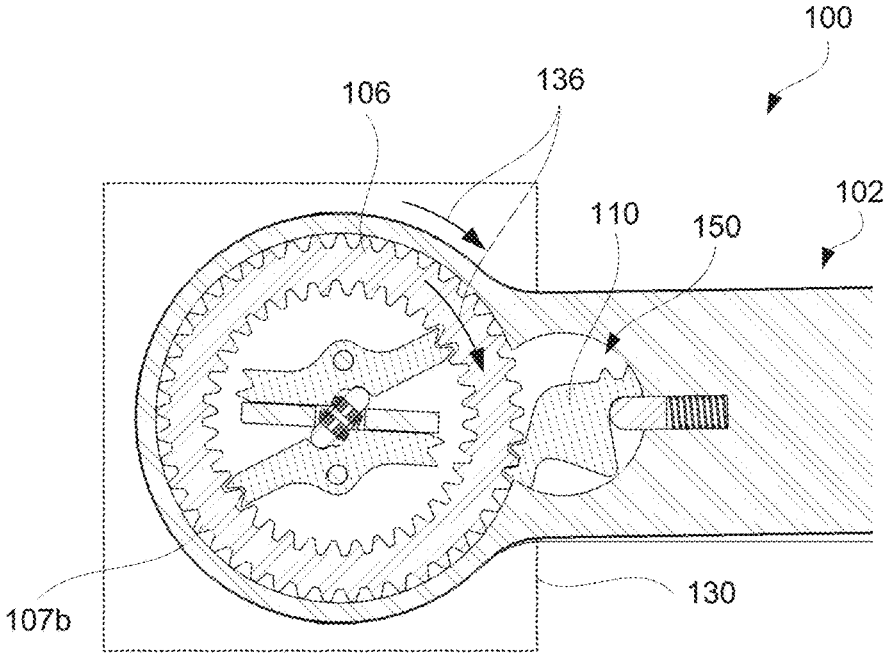
Figure 2F:
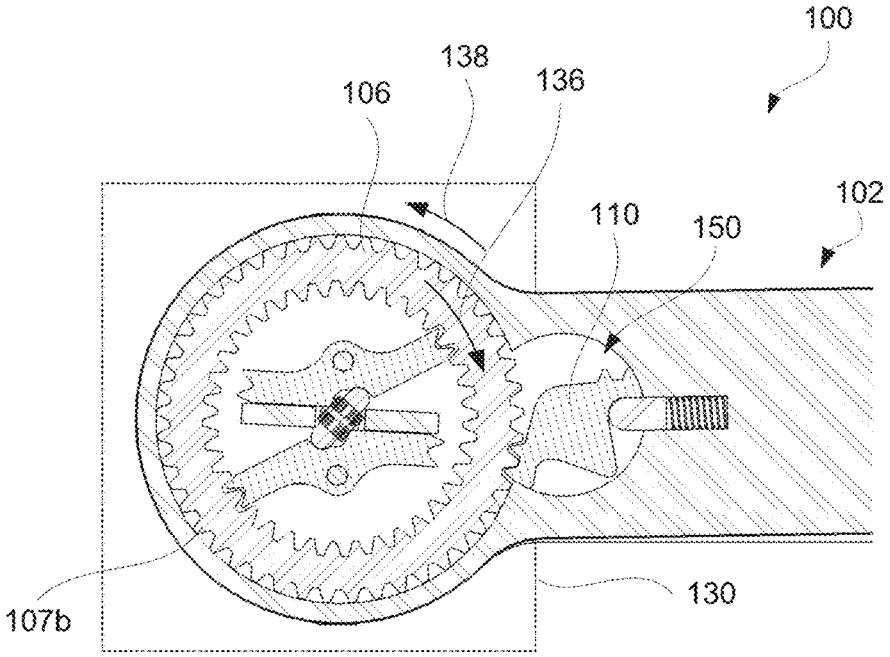
Figure 2G:
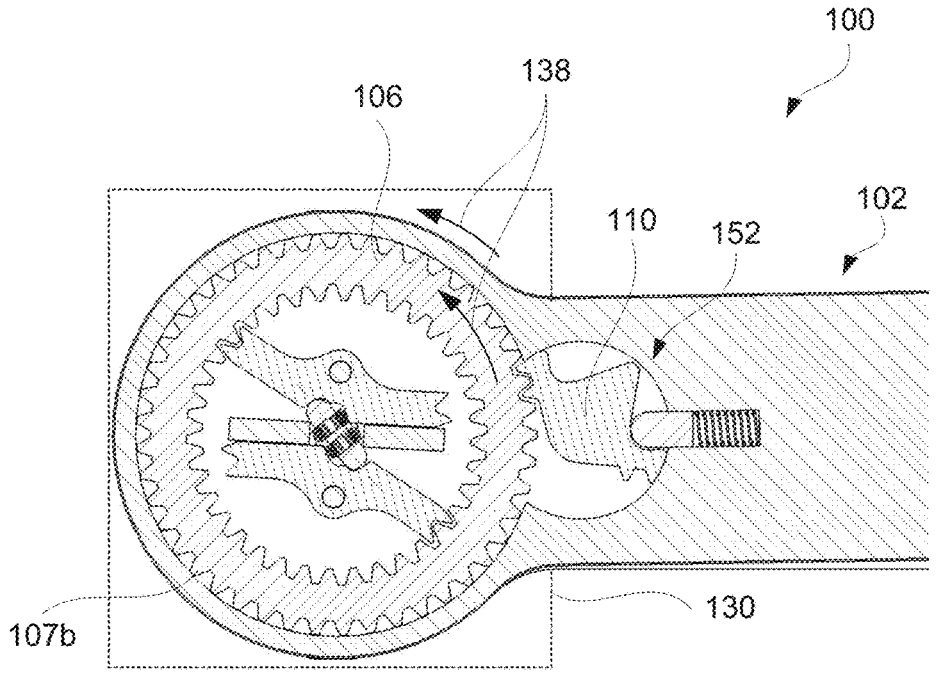

When the first pawl 110 operatively engages the external gear 107*b* as, for example, shown in FIGS. 2E and 2G, the external gear 107*b* cannot turn relative to the first pawl 110 or, more generally, the drive 106 cannot turn relative to the first handle 102. Specifically, FIG. 2E illustrates an example in which the first pawl 110 is in the first position 150 and operatively engages the external gear 107*b* when the drive 106 rotates in the first direction 136 relative to the part 130. In this example, the first handle 102 rotates in the first direction 136 relative to the part 130 and transfers the torque to the drive 106 through the first pawl 110 thereby causing the drive 106 to rotate in the first direction 136 as well. An example illustrated in FIG. 2G has a similar operative engagement. However, in this example, the first pawl 110 is in the second position 152 and operatively engages the external gear 107*b* when the drive 106 rotates in the second direction 138 relative to the part 130. As such, when the first handle 102 rotates in the second direction 138 relative to the part 130, the first handle 102 transfers the torque to the drive 106 through the first pawl 110 thereby causing the drive 106 to rotate in the second direction 138 as well.

Figure 2H:
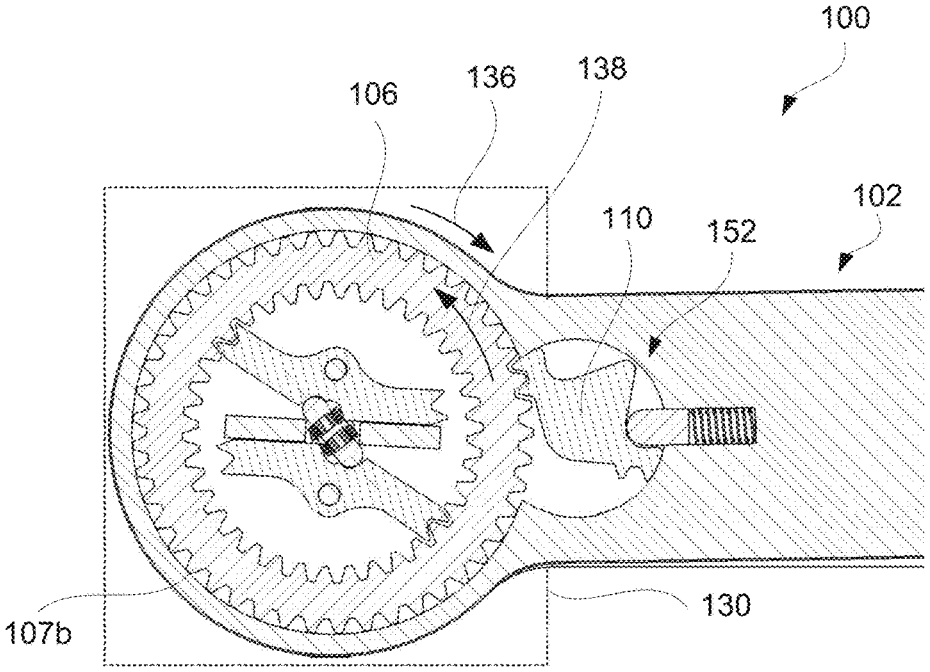

When the first pawl 110 does not operatively engage the external gear 107*b* as, for example, shown in FIGS. 2F and 2H, the external gear 107*b* can turn relative to the first pawl 110 or, more generally, the drive 106 can turn relative to the first handle 102. In this case, the planetary gear mechanism 108 can be used, for example, to transfer torque to the drive 106. Specifically, FIG. 2F illustrates an example in which the first pawl 110 is in the first position 150 and does not operatively engage the external gear 107*b* when the drive 106 rotates in the first direction 136 relative to the part 130. The first handle 102 rotates in the second direction 138 in this case. Instead, the at least one second pawl 112 may operatively engage the internal gear 107*a* as further described below. An example illustrated in FIG. 2H has a similar operative disengagement between the first pawl 110 and the external gear 107*b*. However, in this example, the first pawl 110 is in the second position 152 and does not operatively engage the external gear 107*b* when the drive 106 rotates in the second direction 138 relative to the part 130. The first handle 102 rotates in the first direction 136 in this case. Instead, the at least one second pawl may operatively engage the internal gear 107*a* as further described below in this situation.

The wrench 100 may include a switching member for moving the first pawl 110 between the first position 150 and the second position 152. The switching member of the first pawl 110 may be linked to the rotary switch member 113 of the second pawl 112 such that switching of either one of these pawls causes switching of the other pawl. Furthermore, the wrench 100 may include means 116 for biasing the first pawl 110 against the external gear 107*b* of the drive 106. One example of the means 116 includes a spring as, for example, shown in FIG. 2C. More specifically, the means 116 may be a coil spring, a leaf spring, a conical or undulating washer, such as a Belleville washer, or still another mechanical, metallic, or resilient elastomeric spring arrangement. Alternatively, instead of or in addition to the spring, the means 116 may include a gas spring or a magnetic repulsion arrangement. The means 116 may include an active or powered element, such as a solenoid device, or electromagnetic field, pressurized fluid, or a finger, lever, gear, wedge, or other mechanical element moved under power.

Referring to FIGS. 2I-2L, in one aspect of the disclosure, which may include at least a portion of the subject matter of any of the preceding and/or following examples and aspects, the at least one second pawl 112 is movable between a third position 140 (e.g., FIGS. 2I and 2J) and a fourth position 142 (e.g., FIGS. 2K and 2L), relative to the sun-gear component 125. As shown, for example, in FIG. 2J, when the sun-gear component 125 is rotated in the first direction 136 relative to the part 130, the at least one second pawl 112 is in the third position 140, and the at least one second pawl 112 operatively engages the internal gear 107*a* of the drive 106, the drive 106 rotates in the first direction 136 relative to the part 130. As shown, for example, in FIG. 2I, when the sun-gear component 125 is rotated in the second direction 138 relative to the part 130, the at least one second pawl 112 is in the third position 140, and the at least one second pawl 112 does not operatively engage the internal gear 107*a* of the drive 106, the drive 106 rotates in the first direction 136 relative to the part 130. As shown, for example, in FIG. 2L, when the sun-gear component 125 is rotated in the second direction 138 relative to the part 130, the at least one second pawl 112 is in the fourth position 142, and the at least one second pawl 112 operatively engages the internal gear 107*a* of the drive 106, the drive 106 rotates in the second direction 138 relative to the part 130. As shown, for example, in FIG. 2K, when the sun-gear component 125 is rotated in the first direction 136 relative to the part 130, the at least one second pawl 112 is in the fourth position 142, and the at least one second pawl 112 does not operatively engage the internal gear 107*a* of the drive 106, the drive 106 rotates in the second direction 138 relative to the part 130.

Figure 2I:
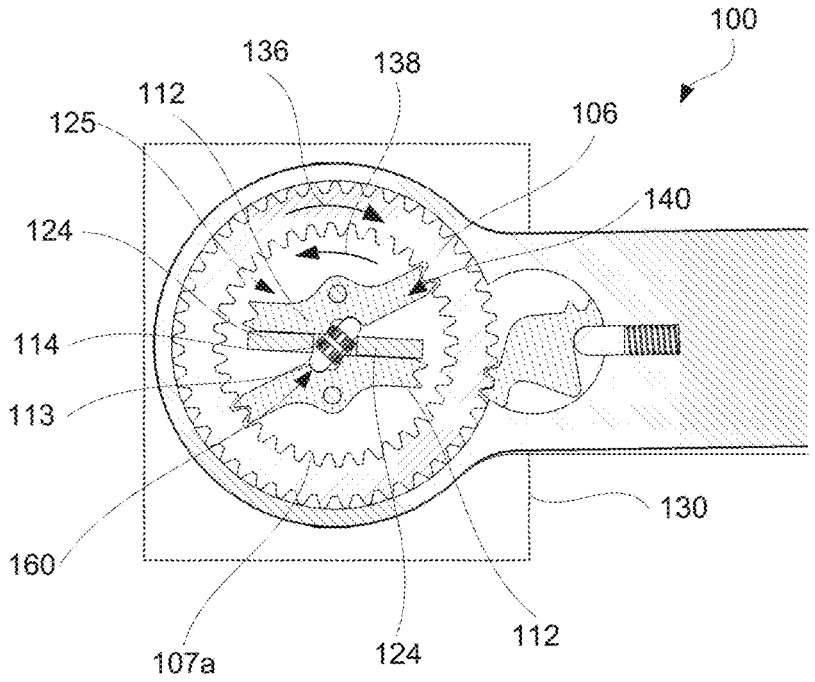
Figure 2J:
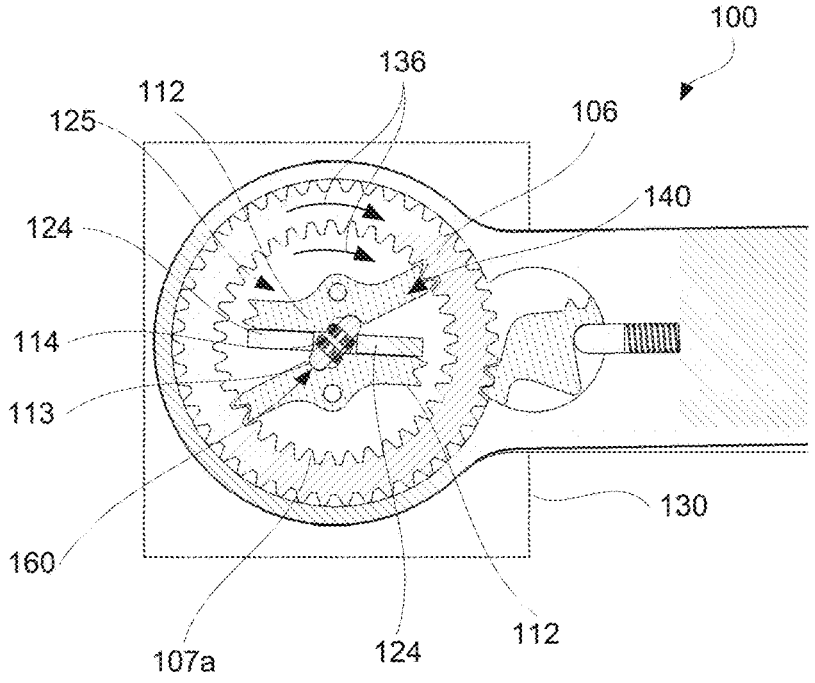
Figure 2K:
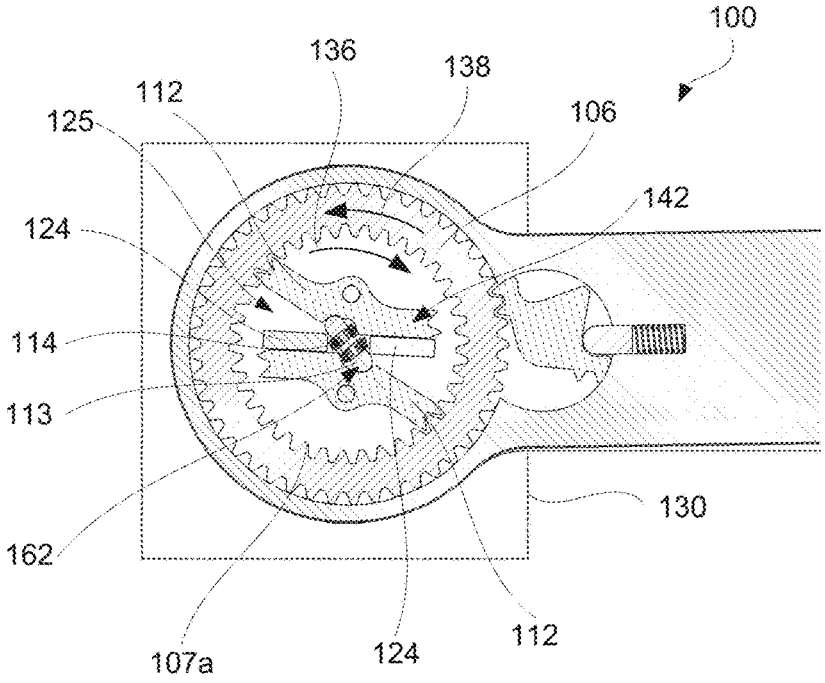
Figure 2L:
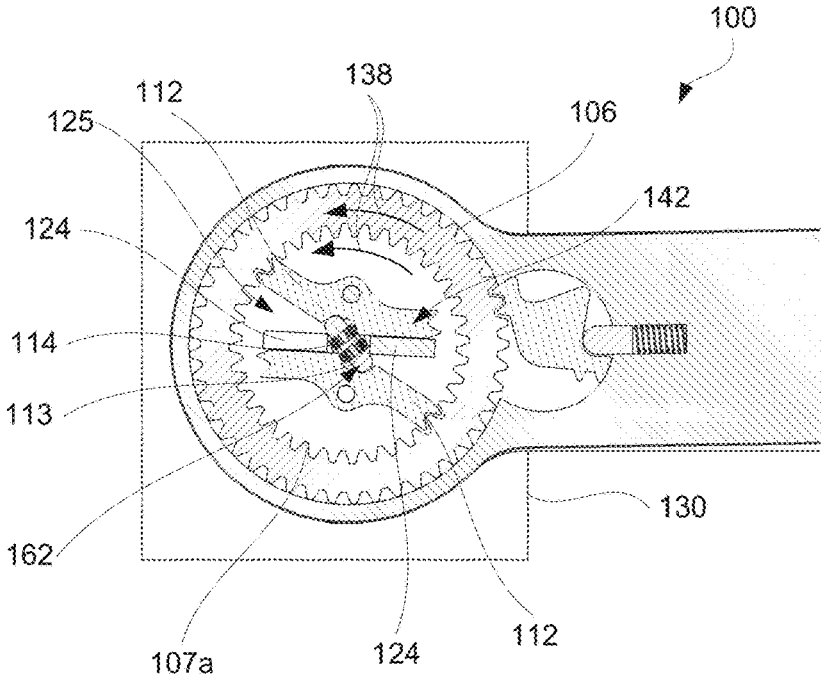

When the at least one second pawl 112 operatively engages the internal gear 107*a* as, for example, shown in FIGS. 2J and 2L, the internal gear 107*a* cannot turn relative to the at least one second pawl 112 or, more generally, the drive 106 cannot turn relative to the sun-gear component 125. Specifically, FIG. 2J illustrates an example in which the at least one second pawl 112 in the third position 140 and operatively engages the internal gear 107*a* when the drive 106 rotates in the first direction 136 relative to the part 130. In this example, the sun-gear component 125 rotates in the first direction 136 relative to the part 130 and transfers the torque to the drive 106 through the at least one second pawl 112 thereby causing the drive 106 to rotate in the first direction 136 as well. The sun-gear component 125 may be rotated by operating the planetary gear mechanism 108 as described elsewhere in this disclosure. An example illustrated in FIG. 2L has a similar operative engagement. However, in this example, the at least one second pawl 112 is in the fourth position 142 and operatively engages the internal gear 107*a* when the drive 106 rotates in the second direction 138 relative to the part 130. As such, when the sun-gear component 125 rotates in the second direction 138 relative to the part 130, the sun-gear component 125 transfers the torque to the drive 106 through the at least one second pawl 112 thereby causing the drive 106 to rotate in the second direction 138 as well.

When the at least one second pawl 112 does not operatively engage the internal gear 107*a* as, for example shown in FIGS. 2I and 2K, the internal gear 107*a* can turn relative to the at least one second pawl 112 or, more generally, relative to the sun-gear component 125. In this case, the first handle 102 can be used, for example, to transfer torque to the drive 106 as, for example, described above. FIG. 2I illustrates an example in which the at least one second pawl 112 does not operatively engage the internal gear 107*a* when the drive 106 rotates in the first direction 136 relative to the part 130. In this example, the at least one second pawl 112 is in the third position 140. The sun-gear component 125 may rotate in the second direction 138. An example illustrated in FIG. 2K has a similar operative disengagement between the at least one second pawl 112 and the internal gear 107*a*.

However, in this example, the at least one second pawl 112 is in the fourth position 142 and does not operatively engage the internal gear 107*a* when the drive 106 rotates in the second direction 138 relative to the part 130. The sun-gear component 125 may rotate in the first direction 136.

Referring, e.g., to FIGS. 2A and 2I-2L, in one aspect of the disclosure, which may include at least a portion of the subject matter of any of the preceding and/or following examples and aspects, the wrench 100 includes a rotary switch member 113 movable between a first rotary-switch position 160 relative to the sun-gear component 125 and a second rotary-switch position 162 relative to the sun-gear component 125. As shown, e.g., in FIGS. 2I and 2J, the first rotary-switch position 160 is associated with the third position 140 of the at least one second pawl 112. As shown, e.g., in FIGS. 2K and 2L, the second rotary-switch position 162 is associated with the fourth position 142 of the at least one second pawl 112. The rotary switch member 113 may protrude through the sun-gear component 125 and the planetary carrier 126. Moving the rotary switch member 113 into the first rotary-switch position moves the at least one second pawl 112 into the third position. As noted above, in this position, the at least one second pawl 112 operatively may engage the internal gear 107*a* of the drive 106 when the drive 106 is rotated in the first direction relative to the part 130 and does not operatively engage the internal gear 107*a* of the drive 106 when the drive is rotated in the second direction relative to the part 130. Moving the rotary switch member 113 into the second rotary-switch position moves the at least one second pawl 112 into the fourth position. In this position, the at least one second pawl 112 operatively engages the internal gear 107*a* of the drive 106 when the drive 106 is rotated in the second direction relative to the part 130 and does not operatively engage the internal gear 107*a* of the drive 106 when the drive 106 is rotated in the first direction. Overall, the rotary switch member 113 may be used to control engagement between the at least one second pawl 112 and the internal gear 107*a*. The same rotary switch member 113 may control position of multiple second pawls 112 at the same time as, for example, shown in FIGS. 2A and 2C. Furthermore, the rotary switch member 113 may be linked to the rotary switch member of the first pawl 110 such that switching of either one of the first pawl 110 or the second pawl 112 cause the other pawl to switch too.

Referring, e.g., to FIG. 2D, in one aspect of the disclosure, which may include at least a portion of the subject matter of any of the preceding and/or following examples and aspects, the sun-gear component 125 has a flange 123 including a load-bearing projection 124. The load-bearing projection 124 may extend substantially normal to the flange 123. More generally, the load-bearing projection 124 may extend in the direction parallel to the torque direction. The load-bearing projection 124 may have a surface for engaging with the at least one second pawl 112. The flange 123 may be used to support and/or couple to other components of the wrench 00. In some examples, the sub-gear component 125 may include two or more load-bear projections 124. The number of the load-bear projections 124 may be the same as the number of the at least one second pawls 112.

Referring, for example, to FIG. 2C, in one aspect of the disclosure, which may include at least a portion of the subject matter of any of the preceding and/or following examples and aspects, the at least one second pawl 112 is movably coupled to the flange 123 and contacts the load-bearing projection 124 when engaging the internal gear 107*a*. More specifically, the at least one second pawl 112 may be rotatably coupled to the flange 123. This coupling allows the at least one second pawl 112 to move between its two positions with respect to the internal gear 107*a* and either engage the internal gear 107*a* or not. The engagement depends in the position of the at least one second pawl 112 and on the rotation direction of the drive 106 with respect to the part 130. The coupling may be formed by the cylindrical post 133 connected to the flange 123 and protruding into an opening of the at least one second pawl 112. In some aspects, the at least one second pawl 112 may be rotatably coupled to the flange 123 on one side of this flange 123, while the sun gear 122 may be disposed on the other side of this flange 123 as, for example, shown in FIG. 2D.

Referring, for example, to FIG. 2C, in one aspect of the disclosure, which may include at least a portion of the subject matter of any of the preceding and/or following examples and aspects, the rotary switch member 113 includes means 114 for biasing the at least one second pawl 112 to contact the internal gear 107*a* of the drive 106. When the at least one second pawl 112 is in the third position, the at least one second pawl 112 operatively engages the internal gear 107*a* of the drive 106 when the drive 106 is rotated in the first direction relative to the part 130 and does not operatively engage the internal gear 107*a* of the drive 106 when the drive is rotated relative to the part 130 in the second direction. On the other hand, when the at least one second pawl 112 is in the fourth position, the at least one second pawl 112 operatively engages the internal gear 107*a* of the drive 106 when the drive 106 is rotated in the second direction relative to the part 130 and does not operatively engage the internal gear 107*a* of the drive 106 when the drive 106 is rotated in the first direction. The means 114 may be a spring as, for example, shown in FIG. 2C. The spring may be a coil spring, a leaf spring, a conical or undulating washer, such as a Belleville washer, or still another mechanical, metallic, or resilient elastomeric spring arrangement. Alternatively, instead of or in addition to the spring, the means 114 may include a gas spring or a magnetic repulsion arrangement. The means 114 may include an active or powered element, such as a solenoid device, or electromagnetic field, pressurized fluid, or a finger, lever, gear, wedge, or other mechanical element moved under power to bias the at least one second pawl 112 toward the internal gear 107*a*. In some aspects, the means 114 may be positioned between two second pawls 112 and bias these second pawls 112 towards their respective load-bearing projection 124 as shown in FIG. 2C. Similar biasing devices may be used for the means 116.

Figure 3:
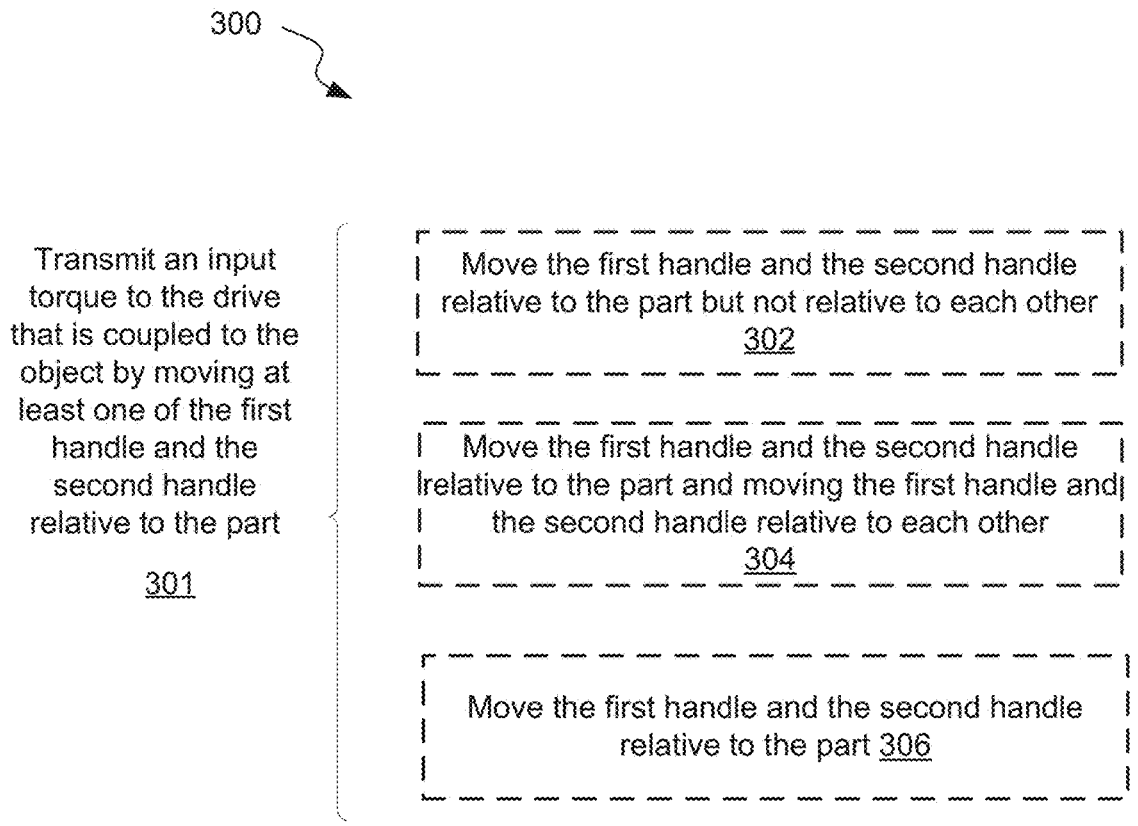

Referring generally to FIGS. 1-2L and 4A-4C and particularly to FIG. 3, one example of the present disclosure relates to a method 300 of applying torque to the object 132 that threadably engages the part 130. The torque is applied using the wrench 100 that includes the drive 106, the first handle 102 coupled to the drive 106, and the second handle 104 coupled to the drive 106 and movable relative to the first handle 102. The method 300 involves transmitting an input torque to the drive 106 that is coupled to the object 132 by rotating at least one of the first handle 102 and the second handle 104 relative to the part 130 (operation 301). In some aspects in order to generate the torque, the force may be applied to the first handle 102 or to both the first handle 102 and the second handle 104. When the force is applied to the first handle 102 only, the second handle 104 or, more specifically, the planetary gear mechanism 108 is disengaged from the drive 106. The first handle 102 is engaged to the drive through the first pawl 110. In this case, the direction of the object 132 rotates in the direction of the force applied to the first handle 102. Alternatively, the force may be applied to both the first handle 102 and the second handle 104. In this case, the first handle 102 and the second handle 104 may rotate with the same rotation speed and in the same direction around the torque axis or the first handle 102 may rotate relative to the second handle 104 around the torque axis. These different types of operations are further described below.

Referring generally to FIGS. 1-2L and 4A-4C and particularly to FIG. 3, in one aspect of the disclosure, which may include at least a portion of the subject matter of any of the preceding and/or following examples and aspects, transmitting the input torque to the drive 106 (operation 301) involves rotating the first handle 102 and the second handle 104 relative to the part 130 but not relative to each other (block 302 in FIG. 3). In this case, the first handle 102 and the second handle 104 rotate in the same direction and with the same rotation speed relative to the part 130 around the torque axis. It should be noted that tilting the second handle 104 with respect to the first handle 102 around a tilt axis that is not parallel to the torque axis may not cause any torque transmitted to the drive. During the operation 301, the force may be applied to the first handle 102 only or to both to the first handle 102 and to the second handle 104. When the force is applied to the first handle 102 only, the first pawl 110 may be engaged, while the at least one second pawl 112 may be disengaged. Alternatively, when the force is applied to both the first handle 102 and the second handle 104, the at least one second pawl 112 is engaged. The first pawl 110 may be engaged or not in this example.

Referring generally to FIGS. 1-2L and 4A-4C and particularly to FIG. 3, in one aspect of the disclosure, which may include at least a portion of the subject matter of any of the preceding and/or following examples and aspects, transmitting the input torque to the drive during operation 301 involves rotating the first handle 102 and the second handle 104 relative to the part 130 and rotating the first handle 102 and the second handle 104 relative to each other (block 304 in FIG. 3). In this case, the first handle 102 and the second handle 104 may rotate around the torque axis in the same direction but with different speeds. Alternatively, the first handle 102 and the second handle 104 may both rotate but in different directions. Furthermore, one of the first handle 102 and the second handle 104 may be stationary, while another one rotates. The force may be applied to the first handle 102 only or to both the first handle 102 and the second handle 104. When the force is applied to the first handle 102 only, the first pawl 110 may be engaged, while the at least one second pawl 112 may be disengaged. Alternatively, when the force is applied to both the first handle 102 and the second handle 104, the at least one second pawl 112 is engaged. The first pawl 110 may be engaged or not in this example.

Referring generally to FIGS. 1-2L and 4D-4E, in one aspect of the disclosure, which may include at least a portion of the subject matter of any of the preceding and/or following examples and aspects, rotating the first handle 102 and the second handle 104 relative to each other in a first direction causes a first torque to be transmitted to the drive 106 in a first torque direction 170, while rotating the first handle 102 and the second handle 104 relative to each other in a second direction opposite to the first direction causes a second torque to be transmitted to the drive 106 in a second torque direction co-directional with the first torque direction. Those skilled in the art will appreciate that torque is a vector quantity, whose direction is perpendicular to the applied force. When the first handle 102 and the second handle 104 are rotated relative to each other around the torque axis in the first direction as, for example, shown in FIG. 4D, the torque may be transferred through the first pawl 110. The first torque is transmitted to the drive 106 in the first torque direction. The rotating direction of the drive 106 is the same as the rotating direction of the first handle 102. However, when the first handle 102 and the second handle 104 rotate around the torque axis relative to each other in the second direction opposite to the first direction as, for example, shown in FIG. 4E, the torque may be transferred through the at least one second pawl 112 and the planetary gear mechanism 108. The rotating direction of the drive 106 may be opposite the rotating direction of the first handle 102.

Referring generally to FIGS. 1-2L and 4A-4C and particularly to FIG. 3, in one aspect of the disclosure, which may include at least a portion of the subject matter of any of the preceding and/or following examples and aspects, transmitting the input torque to the drive 106 during operation 301 involves rotating one of the first handle 102 and the second handle 104 relative to the part 130 (block 304 in FIG. 3). In this case, both the first handle 102 and the second handle 104 rotate relative to the part 130. The first handle 102 and the second handle 104 may be stationary relative to each other or the first handle 102 and the second handle 104 may rotate relative to each other.

Referring generally to FIGS. 1-2L and 4F-4G and particularly to FIG. 3, in one aspect of the disclosure, which may include at least a portion of the subject matter of any of the preceding and/or following examples and aspects, rotating one of the first handle 102 and the second handle 104 relative to the part 130 in a first direction 174 causes a first torque to be transmitted to the drive 106 in a first torque direction 170 and wherein rotating one of the first handle 102 and the second handle 104 relative to the part 130 in a second direction 176 opposite to the first direction 174 causes a second torque to be transmitted to the drive 106 in a second torque direction 172 co-directional with the first torque direction 170. When the first handle 102 and the second handle 104 rotate relative to the part 130 in the first direction 174 or the second direction 176, the first handle 102 and the second handle 104 may be stationary with respect to each other or rotate with respect to each other. For example, one handle of the first handle 102 and the second handle 104 may rotate faster than the other handle.

The disclosure and drawing figure(s) describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, in some aspects of the disclosure, not all operations described herein need be performed.

Figure 5:
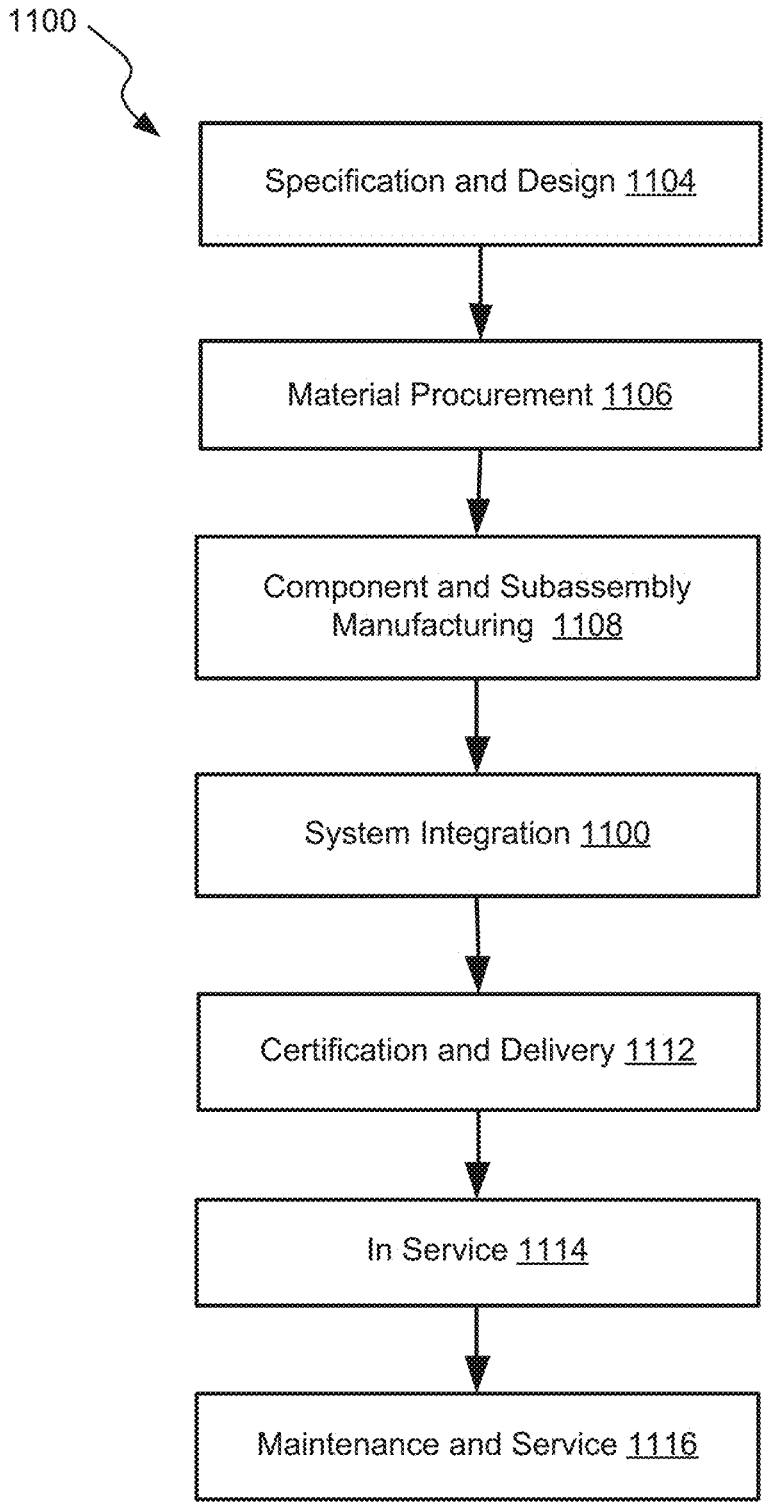
Figure 6:
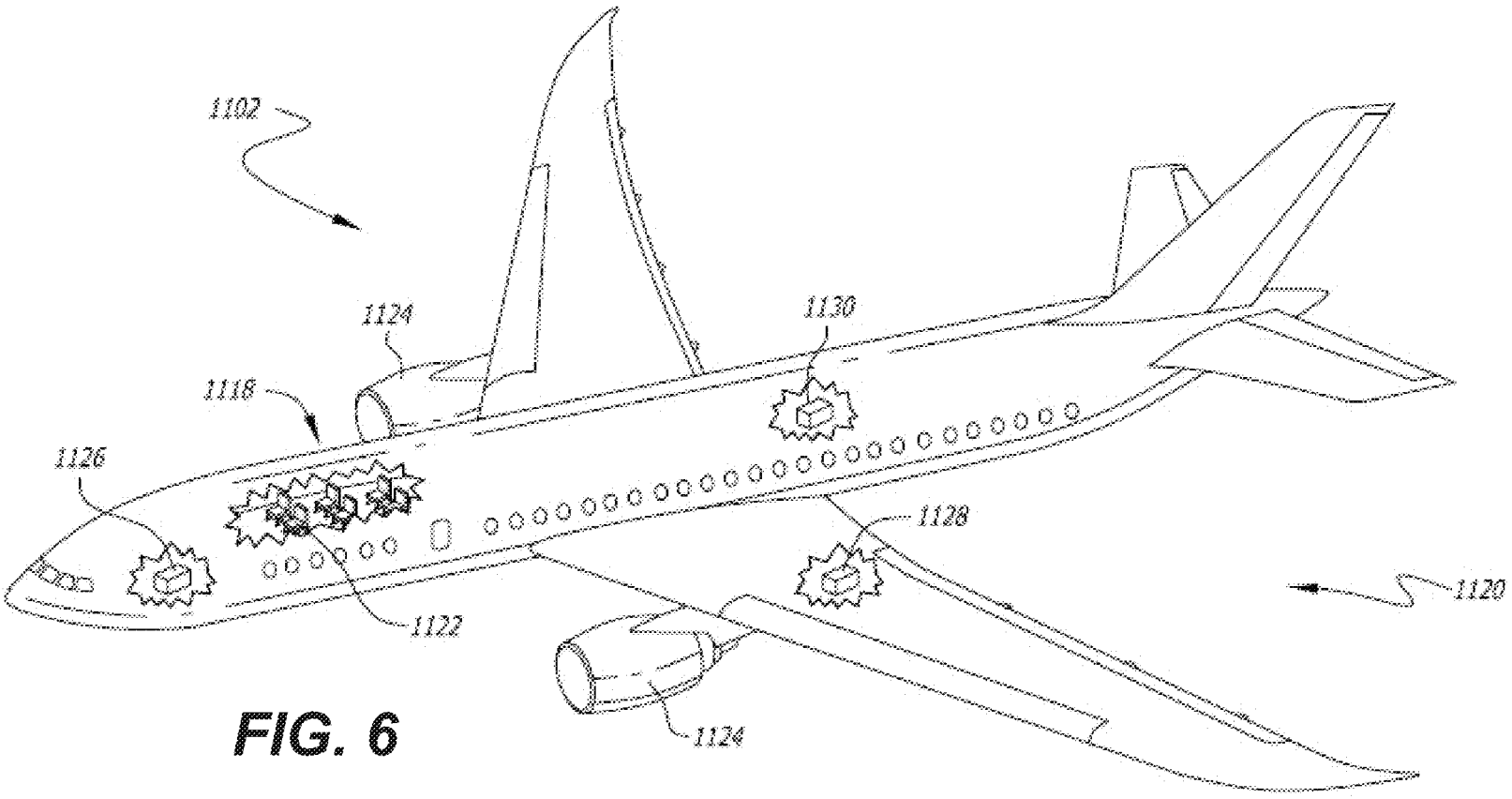

Examples of the disclosure may be described in the context of an aircraft manufacturing and service method 1100 as shown in FIG. 5 and an aircraft 1102 as shown in FIG. 6. During pre-production, illustrative method 1100 may include specification and design 1104 of the aircraft 1102 and material procurement 1106. During production, component and subassembly manufacturing 1108 and system integration 1110 of the aircraft 1102 take place. Thereafter, the aircraft 1102 may go through certification and delivery 1112 to be placed in service 1114. While in service by a customer, the aircraft 1102 is scheduled for routine maintenance and service 1116 (which may also include modification, reconfiguration, refurbishment, and so on).

Each of the processes of the illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 6, the aircraft 1102 produced by the illustrative method 1100 may include an airframe 1118 with a plurality of high-level systems 1120 and an interior 1122. Examples of high-level systems 1120 include one or more of a propulsion system 1124, an electrical system 1126, a hydraulic system 1128, and an environmental system 1130. Any number of other systems may be included. Although an aerospace example is shown, the principles described herein may be applied to other industries, such as the automotive industry.

Apparatus and methods shown or described herein may be employed during any one or more of the stages of the illustrative method 1100. For example, components or subassemblies corresponding to component and subassembly manufacturing 1108 may be fabricated or manufactured in a manner similar to components or subassemblies produced while the aircraft 1102 is in service. Also, one or more aspects of the apparatus, method, or combination thereof may be utilized during the manufacturing 1108 and 1110, for example, by substantially expediting assembly of or reducing the cost of an aircraft 1102. Similarly, one or more aspects of the apparatus or method realizations, or a combination thereof, may be utilized, for example and without limitation, while the aircraft 1102 is in service, e.g., maintenance and service 1116.

Different examples and aspects of the apparatus and methods are disclosed herein that include a variety of components, features, and functionality. It should be understood that the various examples and aspects of the apparatus and methods disclosed herein may include any of the components, features, and functionality of any of the other examples and aspects of the apparatus and methods disclosed herein in any combination, and all of such possibilities are intended to be within the spirit and scope of the present disclosure.

Many modifications and other examples of the disclosure set forth herein will come to mind to one skilled in the art to which the disclosure pertains having the benefit of the teachings presented in the foregoing descriptions and the associated drawings.

Therefore, it is to be understood that the disclosure is not to be limited to the specific embodiments disclosed and that modifications and other embodiments are intended to be included within the scope of the appended claims. Moreover, although the foregoing descriptions and the associated drawings describe example embodiments in the context of certain illustrative combinations of elements and/or functions, it should be appreciated that different combinations of elements and/or functions may be provided by alternative implementations without departing from the scope of the appended claims.

What is claimed is:

1. A method of applying torque to an object that threadably engages a part, the method comprising:

using a wrench, comprising a first handle, a second handle, a planetary gear mechanism, a drive that comprises an internal gear and an external gear, a first pawl, movably coupled to the first handle and biased to contact the external gear of the drive, and a second pawl, movably coupled to a sun-gear component and biased to contact the internal gear of the drive, to transmit an input torque to the drive by rotating at least one of the first handle and the second handle relative to the part when the drive is coupled to the object, wherein the first pawl is movable between a first position and a second position relative to the first handle, and wherein:

the drive rotates in a first direction relative to the part when the first handle is rotated in the first direction relative to the part, the first pawl is in the first position, and the first pawl operatively engages the external gear of the drive;

the drive rotates in the first direction relative to the part when the first handle is rotated in a second direction relative to the part opposite to the first direction, the first pawl is in the first position, and the first pawl does not operatively engage the external gear of the drive;

the drive rotates in the second direction relative to the part when the first handle is rotated in the second direction relative to the part, the first pawl is in the second position, and the first pawl operatively engages the external gear of the drive; and the drive rotates in the second direction relative to the part when the first handle is rotated in the first direction relative to the part, the first pawl is in the second position, and the first pawl does not operatively engage the external gear of the drive.

2. The method of claim 1, wherein transmitting the input torque to the drive further comprises rotating the first handle and the second handle relative to the part but not relative to each other.

3. The method of claim 2, wherein transmitting the input torque to the drive comprises applying a force to the first handle only.

4. The method of claim 2, wherein transmitting the input torque to the drive comprises applying a force to both the first handle and the second handle.

5. The method of claim 1, wherein transmitting the input torque to the drive further comprises rotating the first handle and the second handle relative to the part and rotating the first handle and the second handle relative to each other.

6. The method of claim 5, wherein transmitting the input torque to the drive comprises rotating the first handle and the second handle with different rotational speeds in a common direction.

7. The method of claim 5, wherein transmitting the input torque to the drive comprises rotating the first handle and the second handle in opposite directions.

8. The method of claim 5, wherein rotating the first handle and the second handle relative to each other in the first direction causes a first torque to be transmitted to the drive in a first torque direction and wherein rotating the first handle and the second handle relative to each other in the second direction opposite to the first direction causes a second torque to be transmitted to the drive in a second torque direction co-directional with the first torque direction.

9. The method of claim 1, wherein transmitting an input torque to the drive further comprises rotating one of the first handle and the second handle relative to the part.

10. The method of claim 9, wherein rotating one of the first handle and the second handle relative to the part in the first direction causes a first torque to be transmitted to the drive in a first torque direction and wherein rotating one of the first handle and the second handle relative to the part in the second direction opposite to the first direction causes a second torque to be transmitted to the drive in a second torque direction co-directional with the first torque direction.

11. The method of claim 1, wherein:

the planetary gear mechanism comprises a ring gear, the sun-gear component comprising a sun gear, and a planetary carrier comprising a pinion gear in mesh with the ring gear and the sun gear, the first handle is coupled to the ring gear, and the second handle is coupled to the planetary carrier.

12. The method of claim 11, wherein the ring gear of the planetary gear mechanism is fixed to the first handle.

13. The method of claim 11, wherein the second handle is tiltably coupled to the planetary carrier.

14. The method of claim 11, wherein the planetary carrier is rotatably coupled to the first handle.

15. The method of claim 11, wherein the wrench further comprises at least one second pawl movably coupled to the sun-gear component and biased to contact the internal gear of the drive.

16. The method of claim 15, wherein the at least one second pawl is movable between a third position and a fourth position relative to the sun-gear component, and wherein:

when the sun-gear component is rotated in the first direction relative to the part, the at least one second pawl is in the third position, and the at least one second pawl operatively engages the internal gear of the drive, the drive rotates in the first direction relative to the part;

when the sun-gear component is rotated in the second direction relative to the part, the at least one second pawl is in the third position; and the at least one second pawl does not operatively engage the internal gear of the drive, the drive rotates in the first direction relative to the part, when the sun-gear component is rotated in the second direction relative to the part, the at least one second pawl is in the fourth position, and the at least one second pawl operatively engages the internal gear of the drive, the drive rotates in the second direction relative to the part, and when the sun-gear component is rotated in the first direction relative to the part, the at least one second pawl is in the fourth position, and the at least one second pawl does not operatively engage the internal gear of the drive, the drive rotates in the second direction relative to the part.

17. The method of claim 16, wherein:

the wrench further comprises a rotary switch member, movable between a first rotary-switch position relative to the sun-gear component and a second rotary-switch position relative to the sun-gear component, the first rotary-switch position is associated with the third position of the at least one second pawl, the second rotary-switch position is associated with the fourth position of the least one second pawl, and the rotary switch member protrudes through the sun-gear component and the planetary carrier.

18. The method of claim 1, wherein:

the second handle is rotatably coupled to the first handle, the first handle has a first longitudinal axis, the second handle has a second longitudinal axis, and the first longitudinal axis is not collinear with the second longitudinal axis.

19. The method of claim 1, wherein the second handle is rotatably coupled to the first handle by the planetary gear mechanism.

20. The method of claim 1, wherein transmitting the input torque to the drive comprises rotating the first handle while the second handle is disengaged from the drive.

* * * * *